US007898372B2

(12) United States Patent
Melchionne, Jr.

(10) Patent No.: US 7,898,372 B2
(45) Date of Patent: Mar. 1, 2011

(54) METHOD AND APPARATUS FOR CONTROL CONTACTS OF AN AUTOMATIC TRANSFER SWITCH

(75) Inventor: Rocco M. Melchionne, Jr., Nutley, NJ (US)

(73) Assignee: ASCO Power Technologies, L.P., Florham Park, NJ (US)

( * ) Notice: Subject to any disclaimer, the term of this patent is extended or adjusted under 35 U.S.C. 154(b) by 238 days.

(21) Appl. No.: 11/671,921

(22) Filed: Feb. 6, 2007

(65) Prior Publication Data

US 2008/0035456 A1 Feb. 14, 2008

Related U.S. Application Data

(60) Provisional application No. 60/771,047, filed on Feb. 6, 2006.

(51) Int. Cl.
*H01H 13/70* (2006.01)

(52) U.S. Cl. ..... 335/190; 200/1 V; 200/5 R; 200/18; 200/50.33; 200/50.34; 200/11 TC; 200/1 R; 307/64

(58) Field of Classification Search ..... 200/1 R, 200/1 V, 2, 5 R, 18, 11 TC, 50.33–50.34; 307/64–68; 335/189–190
See application file for complete search history.

(56) References Cited

U.S. PATENT DOCUMENTS

| | | | | |
|---|---|---|---|---|
| 6,693,248 | B1 * | 2/2004 | Schultz | 200/11 TC |
| 6,815,622 | B2 | 11/2004 | Milman et al. | |
| 6,815,624 | B2 * | 11/2004 | Schultz | 200/50.33 |
| 6,849,811 | B1 | 2/2005 | Heflin et al. | |

* cited by examiner

*Primary Examiner*—Ramon M Barrera
(74) *Attorney, Agent, or Firm*—McDonnell Boehnen Hulbert & Berghoff LLP

(57) ABSTRACT

An automatic transfer switch includes a solenoid control contacts assembly, an auxiliary contacts assembly, a dual purpose cam attached to a cylindrical shaped weight, and a solenoid actuator. When energized, the solenoid actuator rotates the cylindrical weight and the dual purpose cam actuates both the solenoid control contacts assembly and the auxiliary contacts assembly.

10 Claims, 13 Drawing Sheets

METHOD AND APPARATUS FOR CONTROL CONTACTS OF AN AUTOMATIC TRANSFER SWITCH

RELATED APPLICATIONS

This application claims priority to provisional application No. 60/771,047, filed Feb. 6, 2006.

BACKGROUND

1. Field of the Application

This application relates generally to electrical power transfer switches. More specifically, the present application relates to automatic transfer switches.

2. Description of Related Art

In general, a typically available automatic transfer switch consists of a number of components. For example, such transfer switches generally comprise a main switch panel with power contacts, a solenoid actuator, a set of solenoid control contacts, and a set of auxiliary contacts. The solenoid actuator typically is used to close and open the power contacts through a mechanical switching mechanism. The auxiliary contacts are used for position sensing which information is used by an electronic controller. The solenoid control contacts control the amount of time that the solenoid is energized. In addition, the auxiliary contacts provide additional functions for the customer.

A power transfer from a "normal" power source to an alternate "emergency" power source is initiated by the electronic controller energizing the solenoid actuator. The solenoid actuator is energized until the switching mechanism is moved to a desired position and the coil control contacts cut off power to the solenoid actuator.

In a typical switch construction, such as the switch construction illustrated in FIG. 1, the auxiliary contacts 10 and the solenoid control contacts 12 are actuated by a moving mechanical linkage 12. Another example of a typical switch construction is illustrated in FIGS. 2-4. In the switch construction illustrated in FIGS. 2-4, the solenoid control contacts 20 are mounted on top of a rotating weight 28 (shown in FIG. 3). The auxiliary contacts 22 are connected to the rotating weight with a link 24. In other methods such as the methods described in U.S. Pat. No. 6,849,811, auxiliary contacts and solenoid control contacts are located apart from the switching mechanism and are attached to moving components of the power contacts. U.S. Pat. No. 6,849,811 is herein entirely incorporated by reference and to which the reader is directed to for further information.

In yet another method, as is described in U.S. Pat. No. 6,815,622, the auxiliary contacts are attached to components of the power contacts. In addition, the solenoid control contacts are connected by a link to the switching mechanism. U.S. Pat. No. 6,815,622 is herein entirely incorporated by reference and to which the reader is directed to for further information.

Although the referenced designs are generally successful in providing functioning auxiliary and coil control contacts having certain advantages, their design features have certain limitations. For example, such known methods may not be fully optimized for parts reduction, efficient assembly, less costly maintenance, and/or improved reliability. As just one example, the design method illustrated in FIG. 1 includes auxiliary contacts and solenoid control contacts coupled together and actuated by a single link having pin joints. During an actuation, the link is often exposed to either tensile or compressive forces. If the bearing friction in the pin joints or the actuation torque of the auxiliary and coil control contacts increases due to wear, contamination, or other situations, the link may bend. Such linkage bending may result in jamming the mechanism. One negative consequence of this situation is that it could affect the time that the solenoid actuator coil is energized and the apparent switch position sensed by the electronic controller through the auxiliary contacts. This may lead to possible coil overheating and switch failure.

The example shown in FIGS. 2-4 has certain design advantages over the design illustrated in FIG. 1. For example, in the design illustrated in FIGS. 2-4, the solenoid control contacts 20 are mounted on top of the rotating weight 28. However, in this method, the auxiliary contacts 22 are actuated by a link 24 as shown in FIG. 4. While the reliability of the coil control contacts is improved over the previously discussed design, the reliability of auxiliary contacts is still dependent on the quality of link connection with the auxiliary contacts 22.

The design examples described in U.S. Pat. Nos. 6,815,622 and 6,849,811 both have the auxiliary contacts located apart from the switching mechanism and connected to the moving components power contacts. Since the auxiliary contacts are on the "other side" of the switch panel, the motion from the solenoid actuator must be translated through a series of components. In this case, the reliability depends upon the quality of each individual component. In addition, the larger the number of components required to actuate either the solenoid control or auxiliary contacts, the greater the probability of incorrect assembly, misalignments, loose parts, excessive wear, inadequate lubrication, or other similar mechanical type problem, which are all possible contributors to solenoid actuator overheating and automatic transfer failure.

SUMMARY

In one preferred arrangement, an automatic transfer switch is provided that includes a solenoid control contacts assembly, an auxiliary contacts assembly, a multi or dual purpose cam attached to a cylindrical shaped weight, and a solenoid actuator. When energized, the solenoid actuator rotates the cylindrical weight and the dual purpose cam actuates both the solenoid control contacts assembly and the auxiliary contacts assembly.

The method of actuating the contacts has a number of design advantages. For example, one advantage is that both the auxiliary contacts and the solenoid control contacts are located next to the solenoid actuator. One advantage of this arrangement is that there is no need for additional linkages. Another advantage of this arrangement is that both the auxiliary contacts assembly and the solenoid control contacts assembly are actuated by the same dual purpose cam. A further advantage of the method of the present application is that it provides for better control of the timing between solenoid actuator voltage cutoff and closing or opening of the auxiliary contacts.

This method can be utilized to design automatic transfer switches with fewer parts, easier assembly, simpler maintenance, and improved reliability.

In another arrangement, effectively providing an identical function, the dual purpose cam may be a modular design with all modules attached to the rotating weight. In this arrangement, both the auxiliary contacts and the solenoid control contacts are again located next to the solenoid actuator. Therefore, in this alternative arrangement, there is no need for additional linkages. A further advantage of this arrangement is that it provides improved control of the timing between solenoid actuator voltage cutoff and closing or opening of the auxiliary contacts.

These as well as other aspects and advantages will become apparent to those of ordinary skill in the art by reading the following detailed description, with reference where appropriate to the accompanying drawings. Further, it should be understood that the embodiments described in this summary and elsewhere are intended to illustrate the invention by way of example only.

BRIEF DESCRIPTION OF THE DRAWINGS

Exemplary arrangements of the invention are described herein with reference to the drawings, in which.

DETAILED DECSRIPTION

Figure 1:
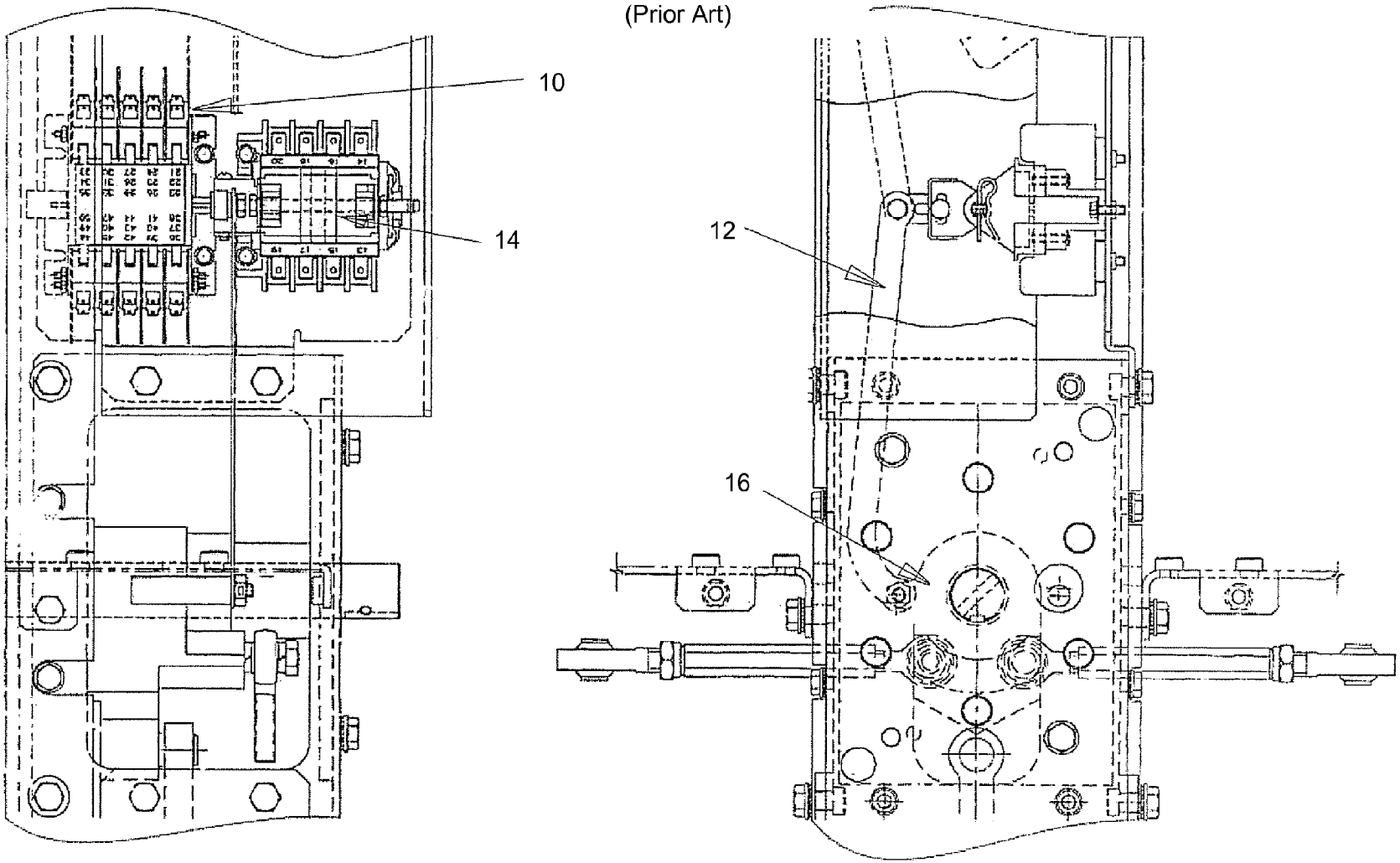
FIGURE 1 (Prior Art)
FIG. 1 illustrates a prior art design method in which auxiliary contacts and the solenoid control contacts are actuated by a linkage.
Figure 2:
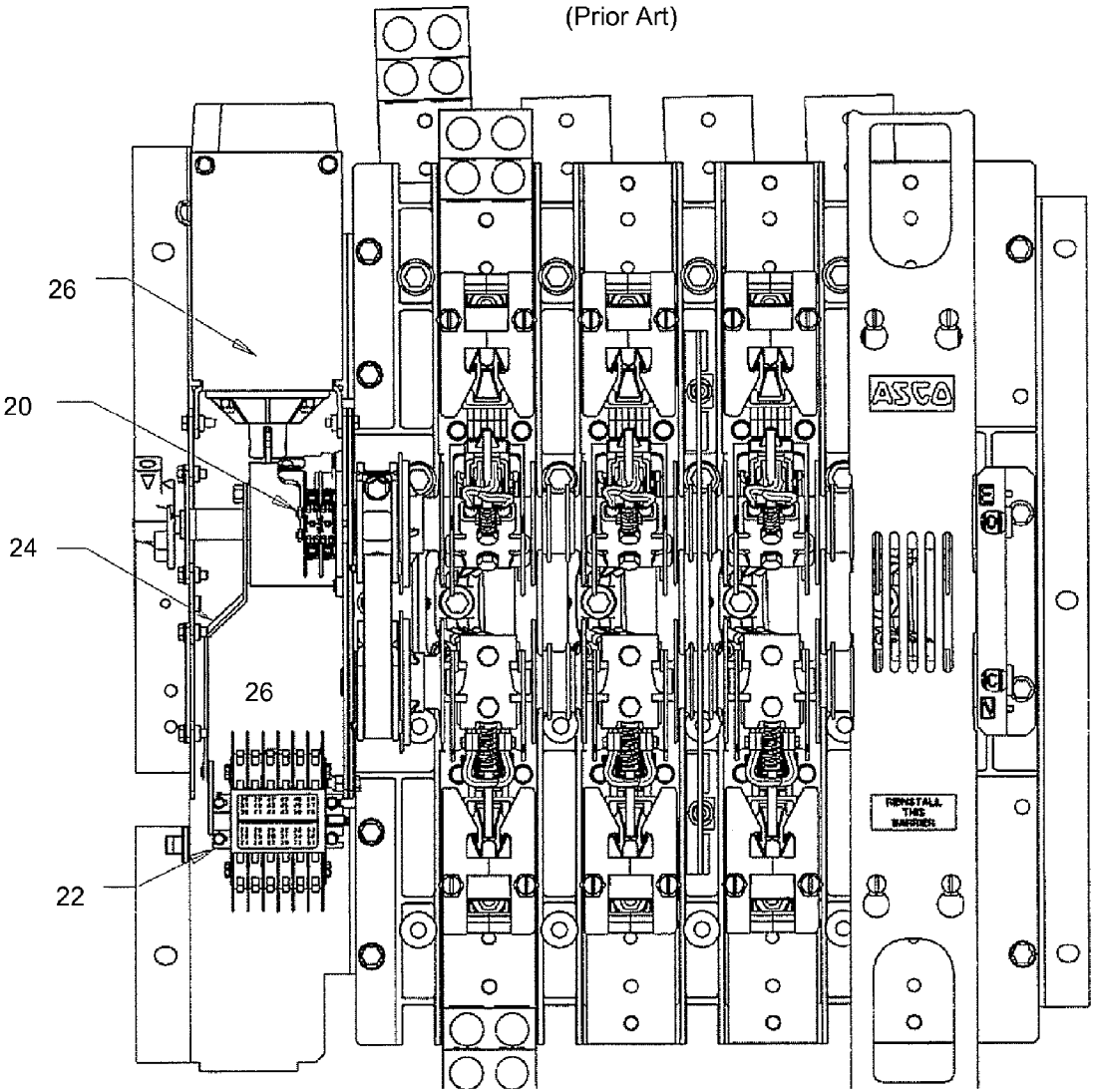
FIGURE 2 (Prior Art)
FIG. 2 illustrates a prior art design method in which the solenoid control contacts are mounted on top of the rotating weight and the auxiliary contacts are mounted separately on the switching mechanism frame and attached to the rotating weight with a linkage.
Figure 3:
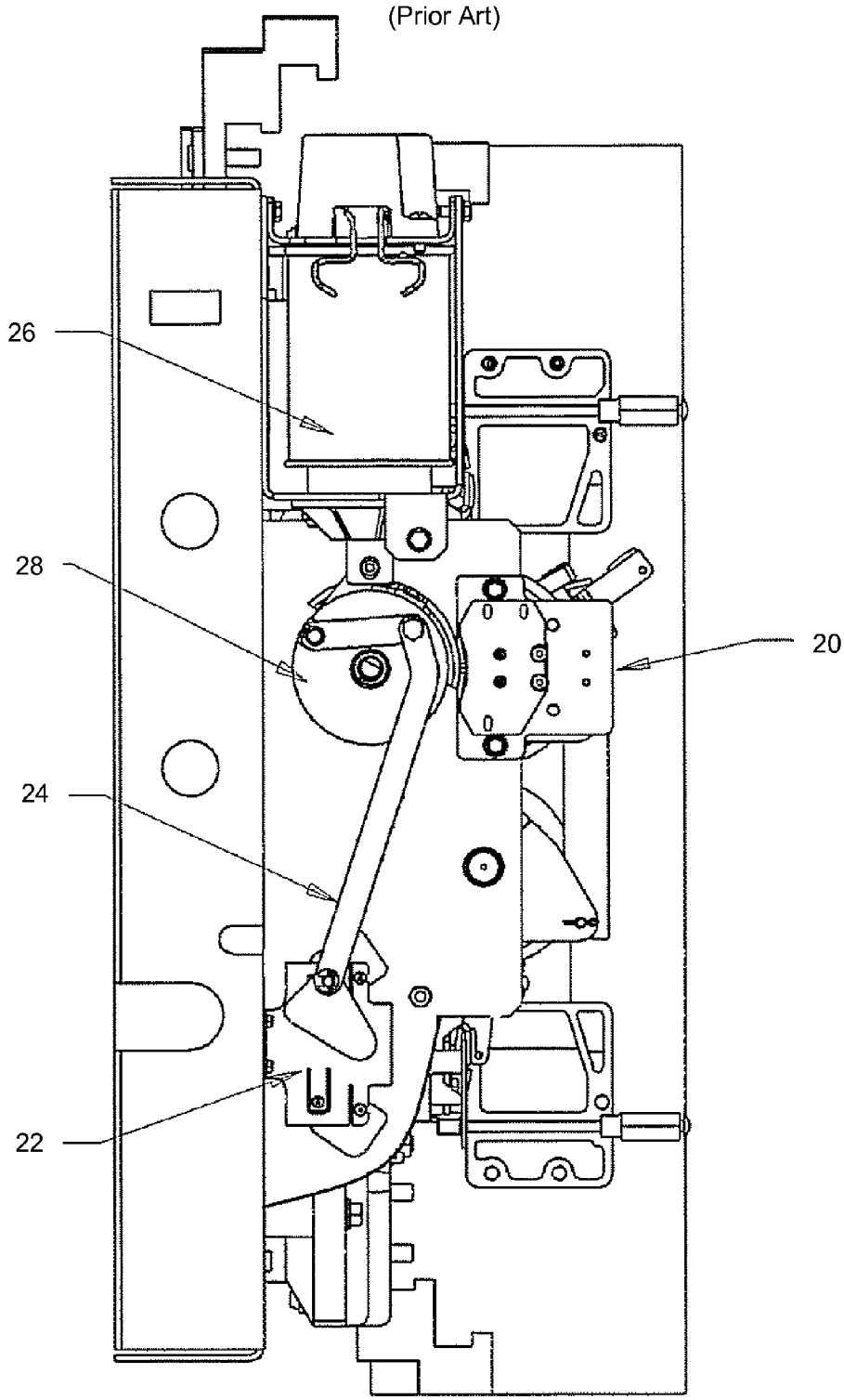
FIGURE 3 (Prior Art)
FIG. 3 is a side view of the prior art design method illustrated in FIG. 2.
Figure 4:
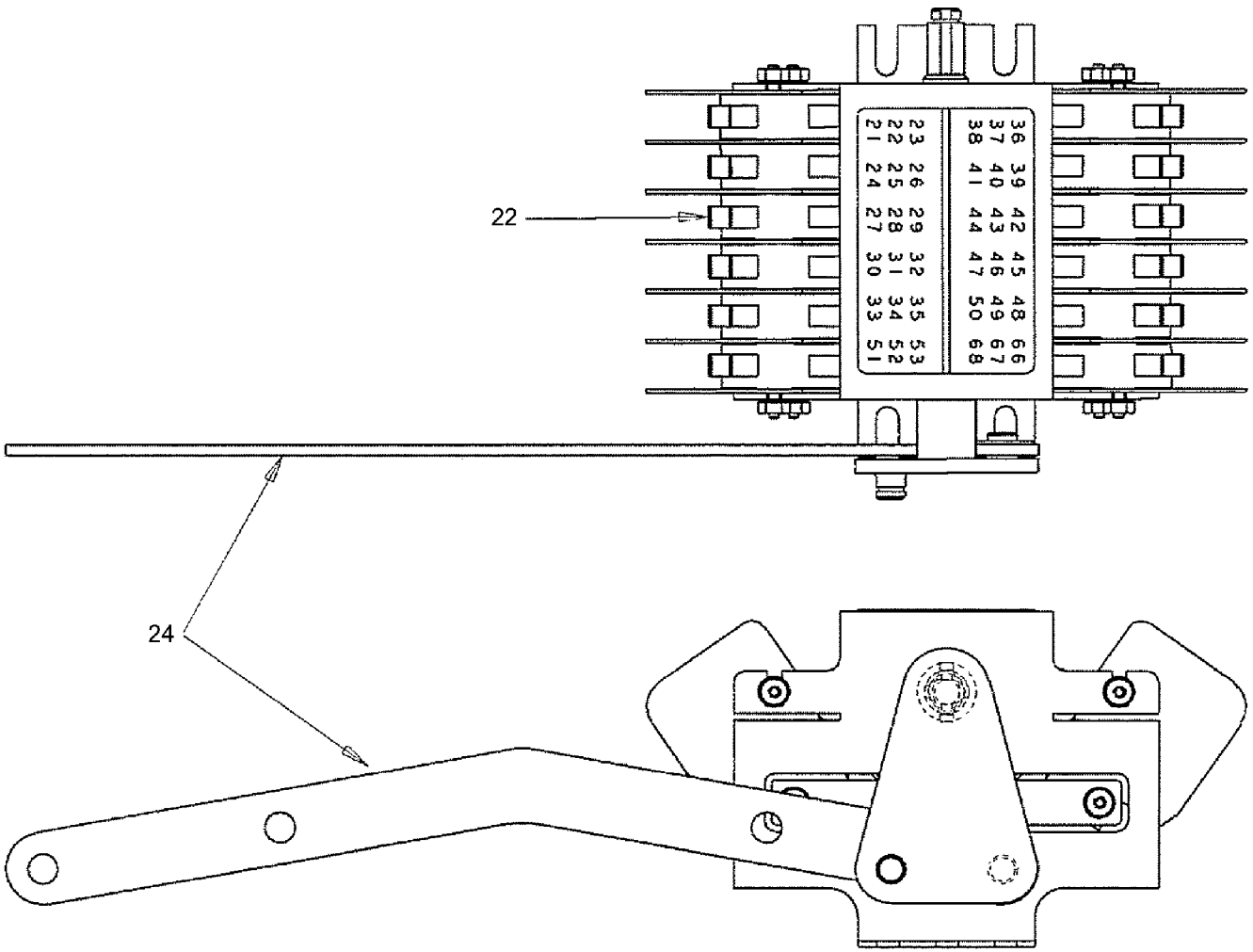
FIGURE 4 (Prior Art)
FIG. 4 shows a detailed view of the auxiliary contacts and the actuation link illustrated in FIGS. 2 and 3.
Figure 5:
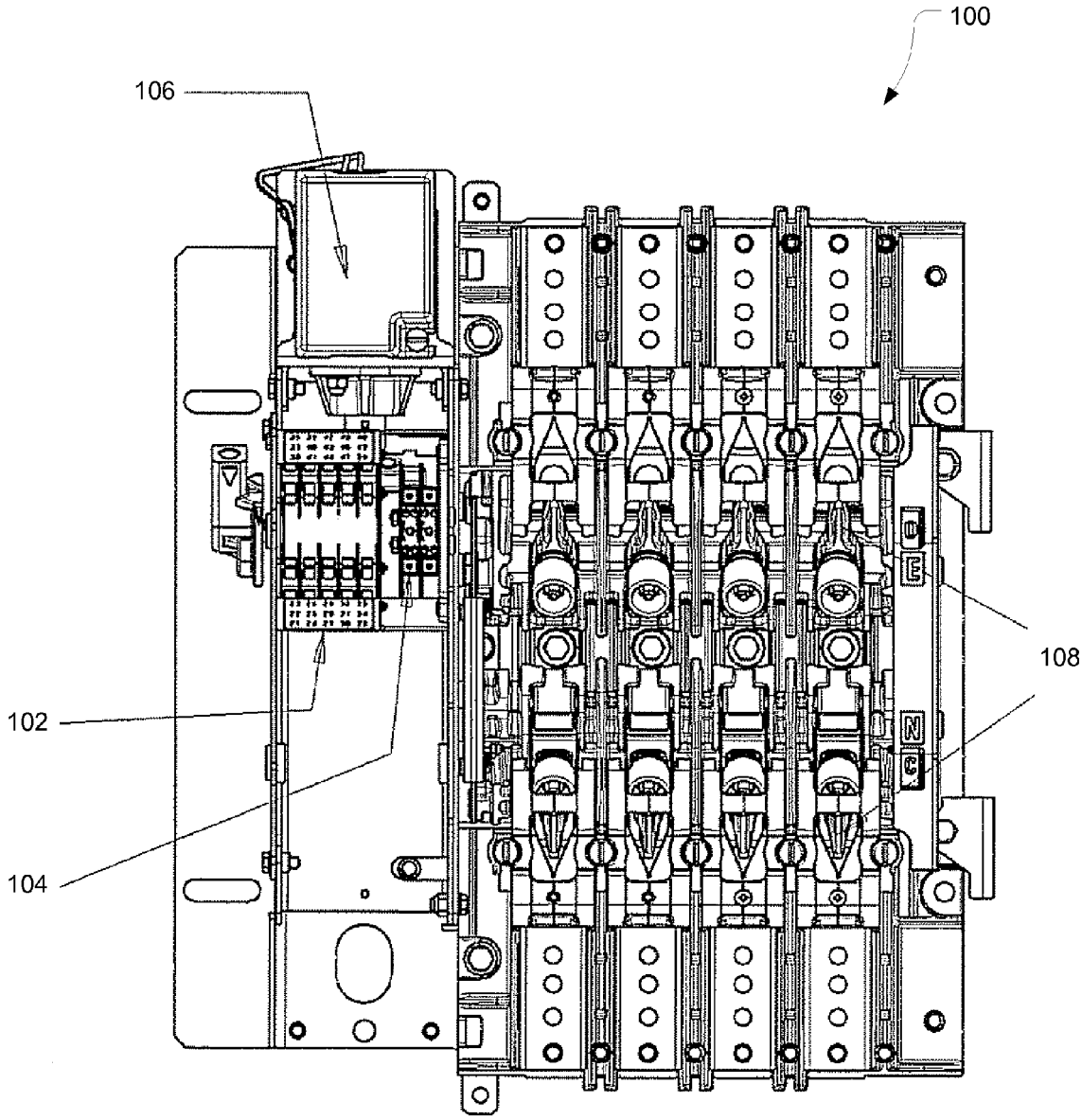
FIG. 5 illustrates solenoid control and auxiliary contacts located above a rotating weight.

Referring to FIG. 5, a transfer switch 100 is illustrated according to a preferred arrangement. The transfer switch 100 comprises an auxiliary contacts assembly 102 and solenoid control contacts assembly 104. Both the auxiliary contacts assembly 102 and solenoid control contacts assembly 104 are located adjacent a solenoid actuator 106. Preferably, the contact assemblies 102 and 104 are actuated by a dual purpose actuation cam 110 (illustrated in FIG. 6).

Figure 6:
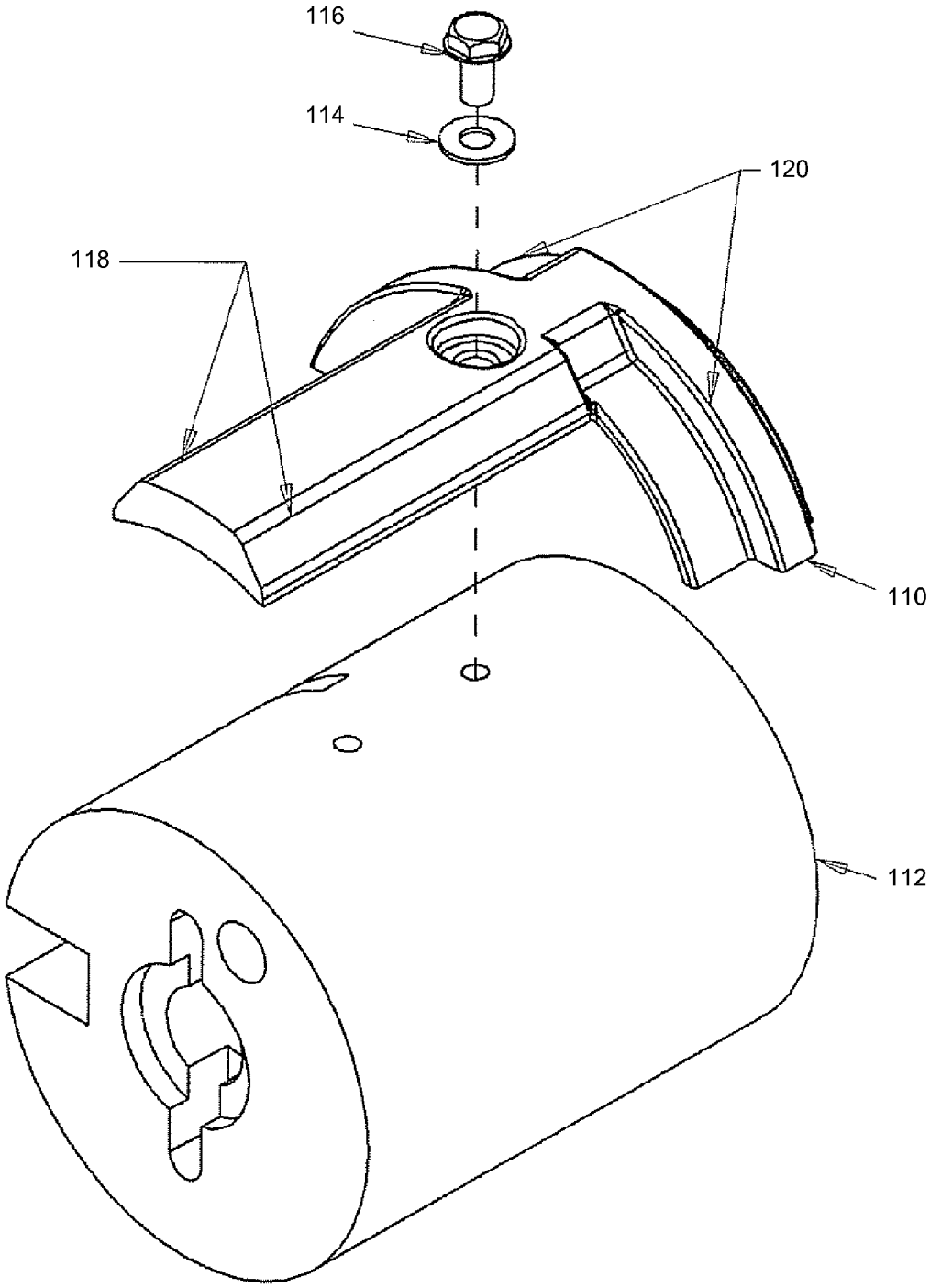
FIG. 6 illustrates a dual purpose cam used to actuate the solenoid control and auxiliary contacts illustrated in FIG. 5.

Referring now to FIG. 6, the actuation cam 110 is attached to a rotating weight 112. Although the rotating weight 112 is illustrated as a weight 112 having a cylindrical shape, alternative shaped weights may also be used. A washer 114 and a screw 116 may be included to secure the actuation cam 110 to the rotating weight 112. Alternatively, in a different arrangement, the actuation cam 110 may be secured to the rotating weight 112 by any other known fastening device.

In this preferred arrangement, the actuation cam 110 has both a first pair of actuating surfaces 118 and a second pair of actuating surfaces 120. The first pair of actuating surfaces 118 is used to actuate the auxiliary contacts 102. The second pair of actuating surfaces 120 is used to actuate the solenoid control contacts 104. Alternative actuating surface configurations may also be used.

Figure 7:
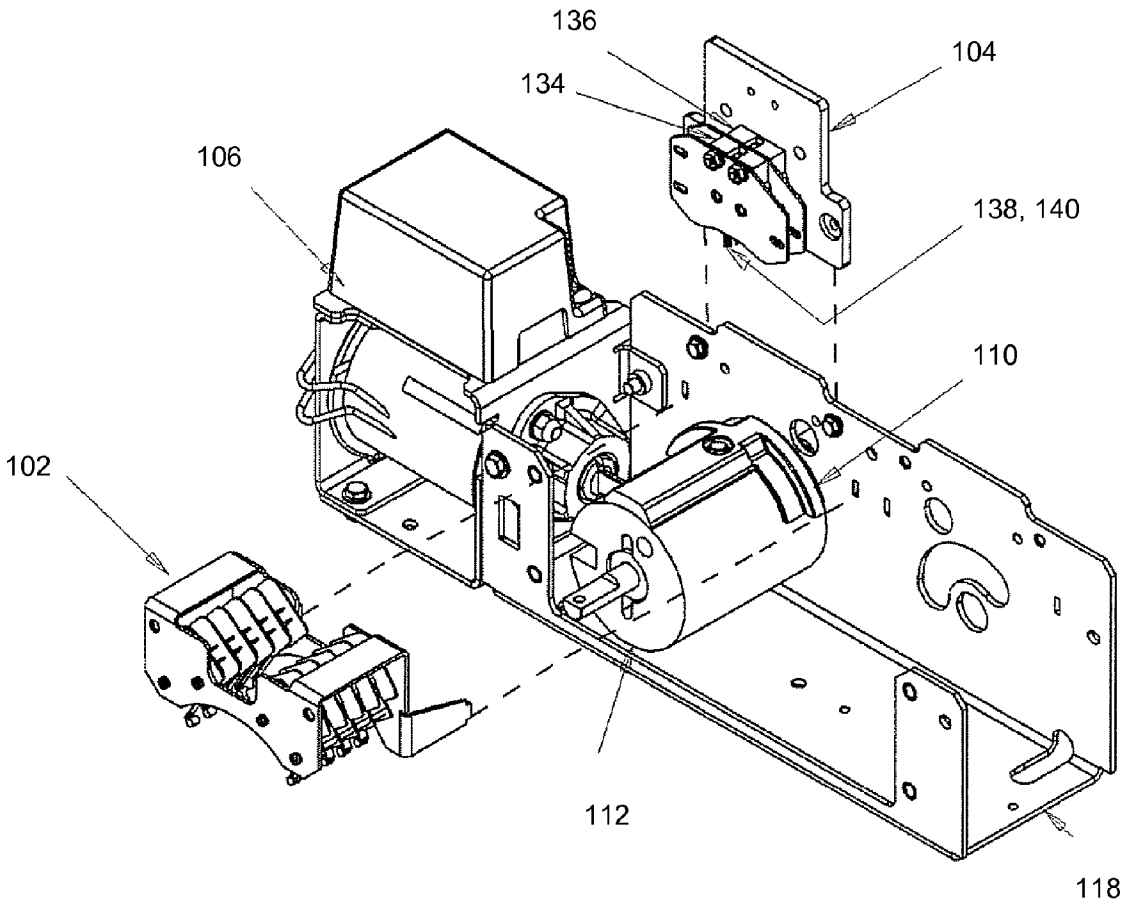
FIG. 7 illustrates the auxiliary contacts assembly and the solenoid control contacts assembly and the solenoid control miniature switches and push-buttons.
Figure 8:
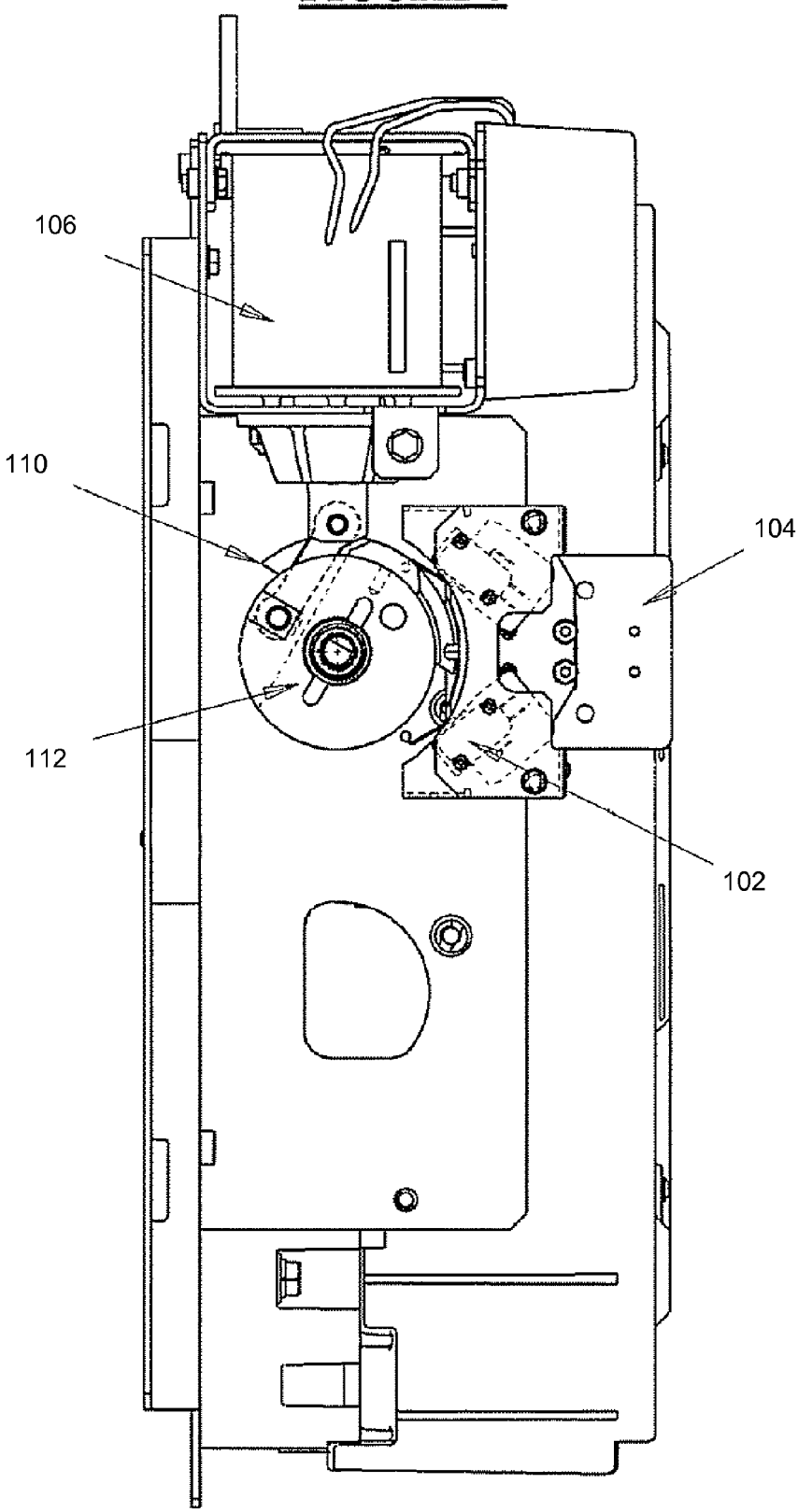
FIG. 8 is a side view of the solenoid control and auxiliary contacts located above a rotating weight illustrated in FIG. 5.

Referring to FIGS. 7 and 8, the auxiliary contacts assembly 102 is located above a narrow portion of the actuation cam 110. The solenoid control contacts assembly 104 is located above the wide portion of the actuation cam 110. Both auxiliary contacts assembly 102 and solenoid control contacts assembly 104 are attached to a common frame 118.

Figure 9:
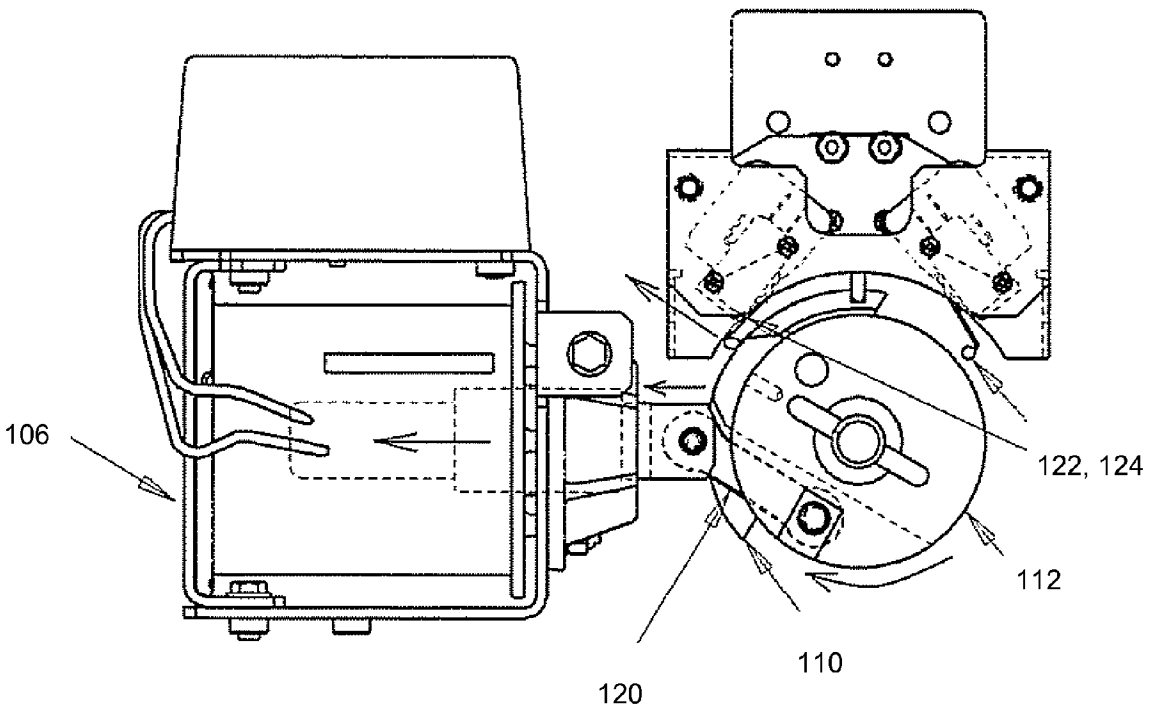
FIG. 9 illustrates the orientation of components in a normal position.

As shown in FIG. 9, a solenoid link 120 is attached between the solenoid actuator 106 and the rotating weight 112. When the solenoid actuator 106 is energized, its linear motion is converted into a rotational motion of the rotating weight 112 through the solenoid link 120. The rotating weight 112 and the actuation cam 110 rotate together between two positions. The first position is the normal position. As referred to before, this normal position is illustrated in FIG. 9. In the normal position, the actuation cam 110 is located on the left side of the rotating weight 112 and therefore displaces the left row of miniature switch levers 122 of the auxiliary contacts 102.

Figure 10:
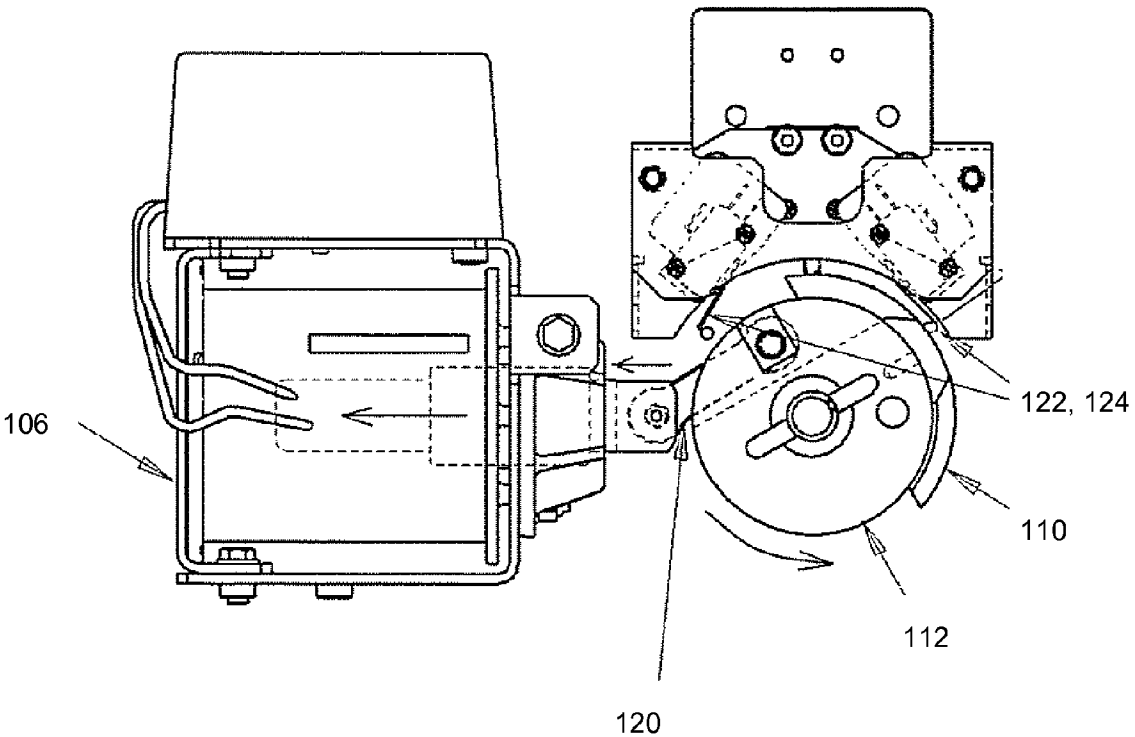
FIG. 10 illustrates the orientation of components in an emergency position.

The second position, or the emergency position, is illustrated in FIG. 10. In the emergency position, the actuation cam 110 is located on the right side of the rotating weight 112. In this location, the actuation cam 110 displaces the right row of miniature switch levers 124 of the auxiliary contacts 102.

Figure 11:
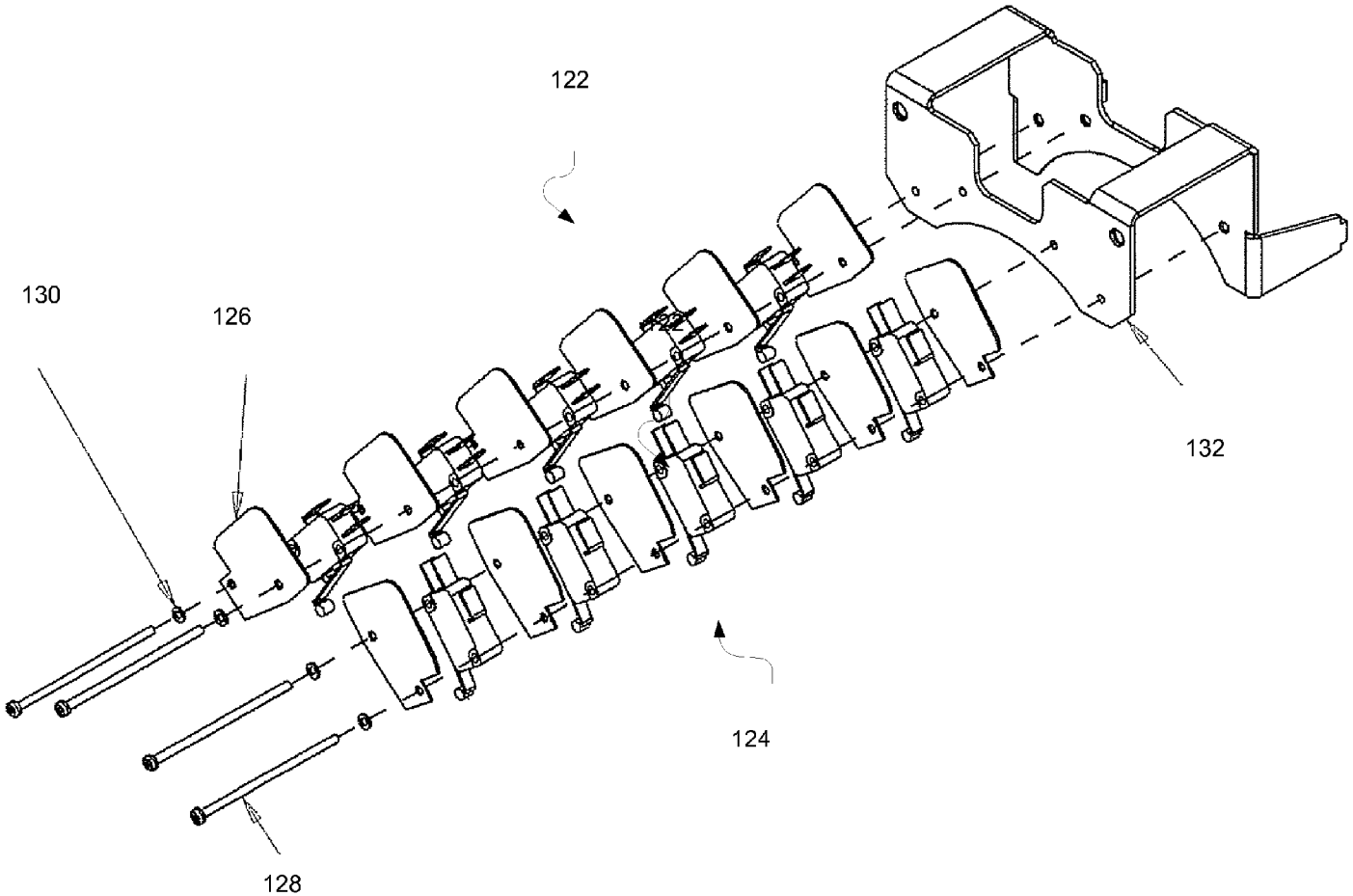
FIG. 11 illustrates the auxiliary contacts assembly in detail.

FIG. 11 illustrates a preferred arrangement of the auxiliary contacts assembly 102. In this arrangement, auxiliary contacts assembly 102 comprises a frame 132, a first set of switches 122, a second set of switches 124, an insulator 126, a plurality of washers 130, and a plurality of screws 128. The first set of switches 122 and the second set of switches 124 are associated with the left "normal" switches and the right "emergency" switches, respectively. The plurality of screws 128 and washers 130 secure the first switches 122 and second switches 124 onto the frame 132 of the auxiliary contacts assembly 102. Alternatively, the switches 122 and 124 may be secured to the frame 132 by any other known fastening device.

Preferably, the solenoid control contacts assembly 104 comprises at least two miniature switches 134 and 136, as shown in FIG. 7. The first miniature switch 134 is used to control the transfer from the normal position to the emergency position. The second miniature switch 136 is used to control the transfer from the emergency position to the normal position. In the normal position, the first miniature switch 134 is closed and the second miniature switch 136 is open. In the emergency position, the first miniature switch 134 is open and the second miniature switch 136 is closed.

Figure 12:
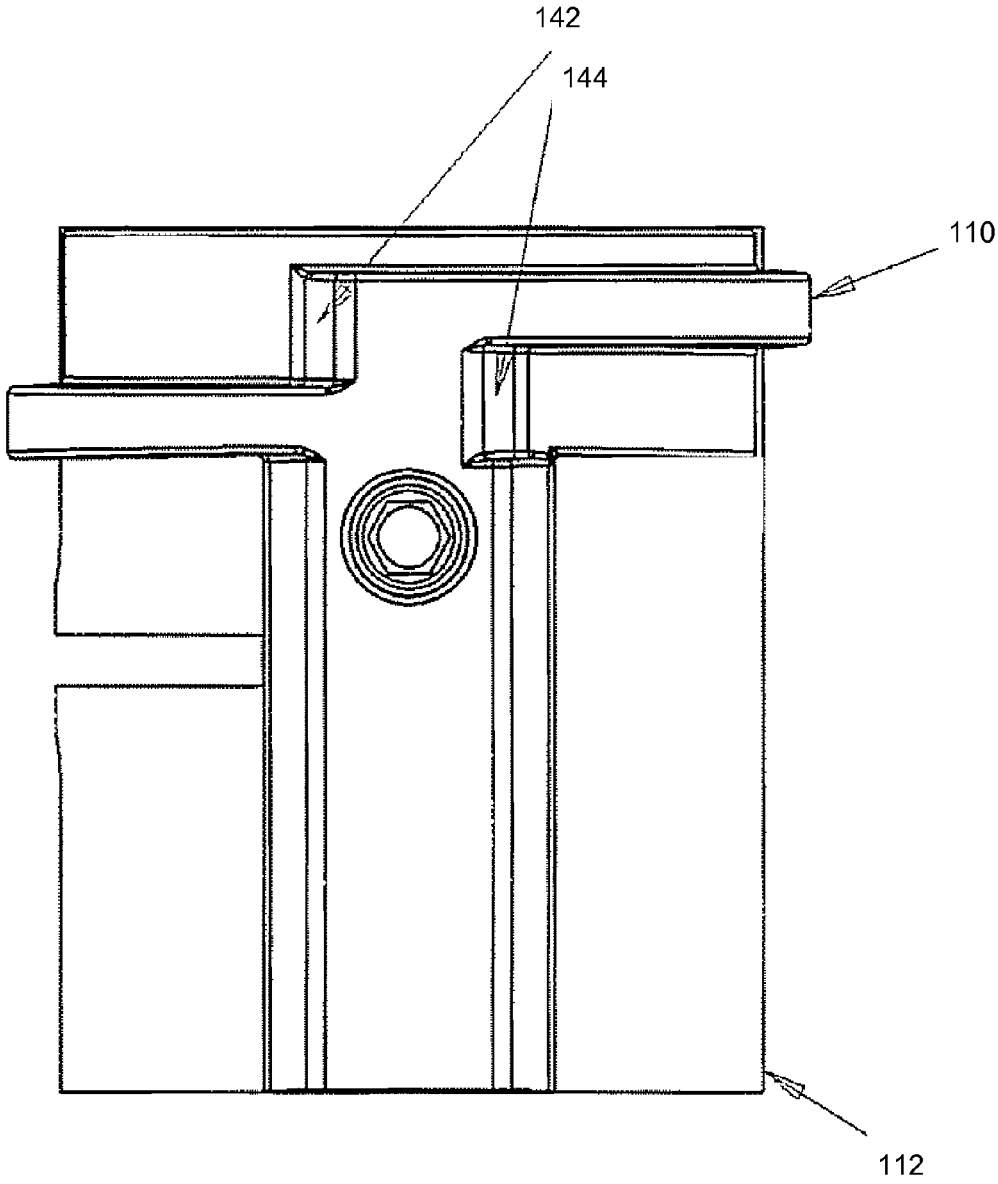
FIG. 12 illustrates the dual purpose cam in detail.

During a power transfer from the normal position to the emergency position, the solenoid actuator 106 is energized through the closed first miniature switch 134. The solenoid actuator 106 remains energized until the first miniature switch 134 opens when its push-button 138 reaches an emergency cutoff surface 142. The emergency cutoff surface 142 of the rotating weight 112 is illustrated in FIG. 12.

During a power transfer from the emergency position to the normal position, the solenoid actuator 106 is energized through the closed second miniature switch 136. The solenoid actuator 106 remains energized until the second miniature switch 136 opens when its push-button 140 reaches a normal cutoff surface 144. The normal cutoff surface 144 of the rotating weight 112 is illustrated in FIG. 12.

Figure 13:
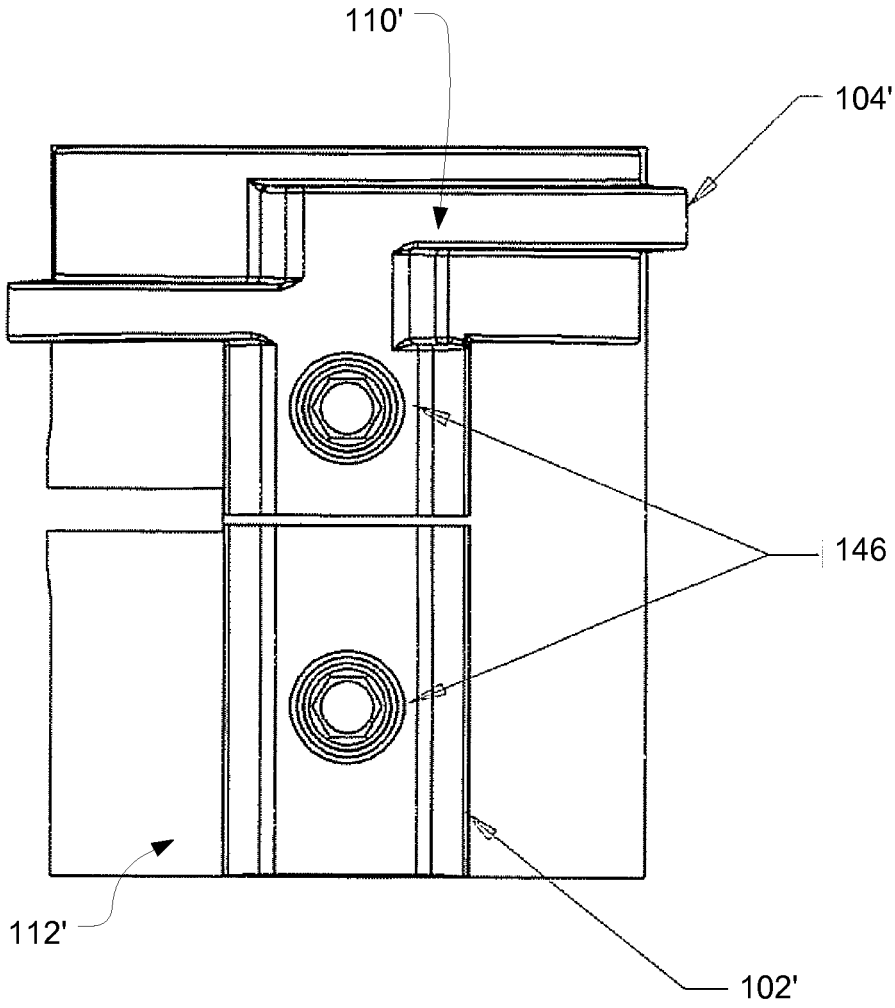
FIG. 13 illustrates an example of a modular dual purpose cam.

Referring to FIG. 13, an alternative arrangement of the transfer switch is illustrated. In this alternative arrangement, the transfer switch includes an auxiliary contacts module 102', a solenoid control contacts module 104', an actuation cam 110', and a rotating weight 112'. The actuation cam 110' is modular and is secured to the rotating weight 112' by fasteners 146.

While certain features and embodiments of the present application have been described in detail herein, it is to be understood that the application encompasses all modifications and enhancements within the scope and spirit of the following claims.

I claim:

1. An automatic transfer switch comprising:

a solenoid actuator;

a solenoid control contacts assembly;

a weight; and a multi-purpose cam configured to actuate the solenoid control contacts assembly and an auxiliary contacts assembly, wherein the multi-purpose cam is mechanically coupled to the weight, and wherein the weight is coupled to the solenoid actuator by a solenoid link;

wherein when the switch is energized, the solenoid actuator moves axially and the solenoid link converts this axial motion into a rotational motion to rotate the weight and the multi-purpose cam so that the multi-purpose cam actuates the solenoid control contacts assembly or the auxiliary contacts assembly.

2. The automatic transfer switch of claim 1 wherein the solenoid control contacts assembly comprise a first set and a second set of miniature switches.

3. The automatic transfer switch of claim 1 wherein the weight comprises a weight having a generally cylindrical shape.

4. The automatic transfer switch of claim 1, further comprising:

said auxiliary contacts assembly, wherein when the switch is energized, the solenoid actuator moves axially and the solenoid link converts this axial motion into the rotational motion to rotate the weight and the multi-purpose cam so that the cam actuates the solenoid contacts assembly and the auxiliary contacts assembly.

5. The automatic transfer switch of claim 4 wherein the solenoid control contacts assembly and the auxiliary contacts assembly reside adjacent one another.

6. The automatic transfer switch of claim 4 wherein the solenoid control contacts assembly and the auxiliary contacts assembly reside adjacent the solenoid actuator.

7. The automatic transfer switch of claim 4 wherein the solenoid actuator; the solenoid control contacts assembly; the auxiliary contacts assembly;

the weight; and the multi-purpose cam are all mounted on a single frame.

8. The automatic transfer switch of claim 7 wherein the single frame is mounted in a switch enclosure, the switch enclosure further comprising switch main contacts.

9. The automatic transfer switch of claim 4 wherein the multi-purpose cam comprises a first actuation surface and a second actuation surface, the first actuation surface associated with actuating the solenoid contacts assembly and the second actuation surface associated with actuating the auxiliary contacts assembly.

10. An automatic transfer switch comprising:

a solenoid actuator;

a solenoid control contacts assembly;

an auxiliary contacts assembly;

a weight; and a multi-purpose cam mechanically coupled to the weight and coupled to the solenoid actuator by a solenoid link;

wherein when the switch is energized, the solenoid actuator moves axially and the solenoid link converts this axial motion into a rotational motion to rotate the weight and the multi-purpose cam so that the cam actuates the solenoid contacts assembly or the auxiliary contacts assembly, wherein the multi-purpose cam comprises a first actuation surface and a second actuation surface, the first actuation surface associated with actuating the solenoid contacts assembly and the second actuation surface associated with actuating the auxiliary contacts assembly.

* * * * *